US005256004A

United States Patent [19]

Gemmi et al.

[11] Patent Number: 5,256,004

[45] Date of Patent: Oct. 26, 1993

[54] METHOD OF FORMING CONSOLIDATED EARTH COLUMNS BY INJECTION AND THE RELEVANT PLANT AND COLUMN

[75] Inventors: Bruno Gemmi, Basilicagoiano; Antonio Sanella, Noceto, both of Italy

[73] Assignee: Fondazioni Speciali, S.r.l., Parma, Italy

[21] Appl. No.: 736,322

[22] Filed: Jul. 26, 1991

[30] Foreign Application Priority Data

Jul. 31, 1990 [IT] Italy ..... 40109 A/90
Jul. 31, 1990 [IT] Italy ..... 40113 A/90

[51] Int. Cl.[5] ..... E02D 5/34

[52] U.S. Cl. ..... 405/237; 405/239; 405/262; 405/269

[58] Field of Search ..... 405/233, 236, 237, 238, 405/239, 240, 244, 269, 262

[56] References Cited

U.S. PATENT DOCUMENTS

| | | | |
|---|---|---|---|
| 2,412,239 | 12/1946 | Weber | 405/237 X |
| 3,255,592 | 6/1966 | Moor | 405/237 X |
| 3,391,544 | 7/1968 | Daczko | 405/237 X |
| 3,742,717 | 7/1973 | Wey | 405/238 |
| 4,624,606 | 11/1986 | Nakanishi et al. | 405/269 |

*Primary Examiner*—David H. Corbin

*Attorney, Agent, or Firm*—Lowe, Price, LeBlanc & Becker

[57] ABSTRACT

A method is provided for forming consolidated earth columns of cement grout or mortar, with reinforcement bars if required, e.g., for use in building foundations or in earth consolidation works in anchoring structures of excavation barriers, which significantly reduces the time taken to form the columns and improves productivity. The method includes the steps of injecting a consolidating grout when drilling into the earth. The drill may be left inside the column if a column with reinforcement bar is required. The plant to put the method into effect has a rotating joint manifold (6) at the upper end of the boring drill (11), equipped with tangentially arranged inlets which may be selectively inclined; and a group distributor body (15) placed at the lower end of the boring drill (11) above the boring tool that is equipped with grout flow devices. If columns with reinforcement bars are required, the boring drill (35) comprises a series of disposable shafts threaded externally at both ends; the lowest bar being equipped with a base piece (40) having a grout ejector nozzle. A formation of blades, constituting the drilling tool, is attached to the bottom of the base piece. The column is cylindrical in shape, with optional downwardly converging cone shaped projections (32, 65) protruding at fixed intervals.

35 Claims, 10 Drawing Sheets

Fig. 3
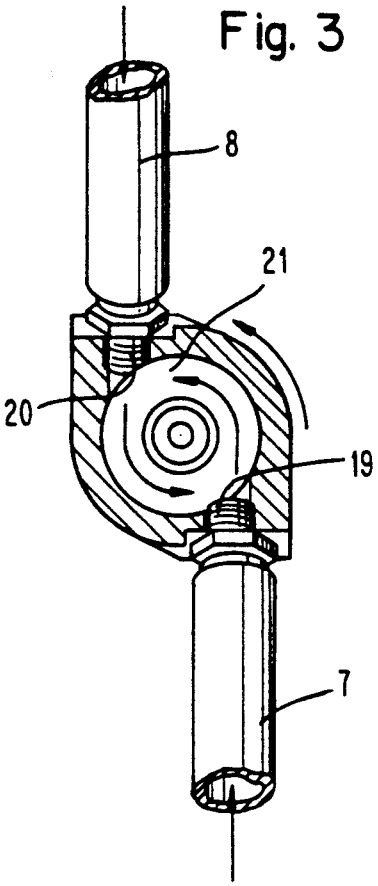
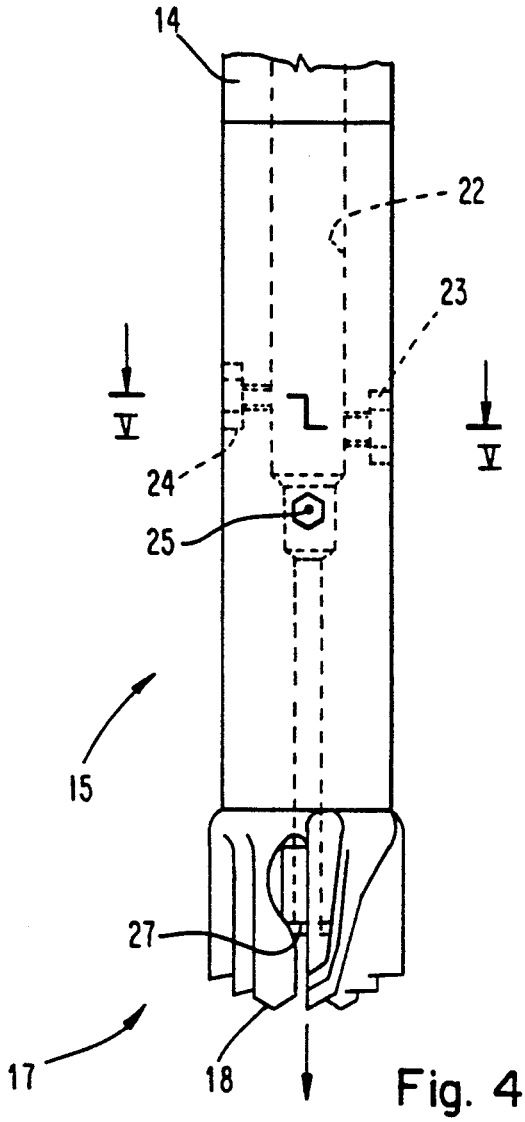
Fig. 4
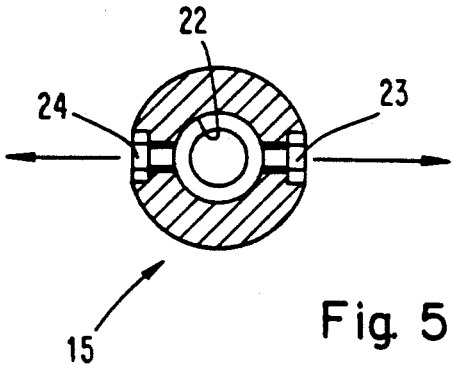
Fig. 5

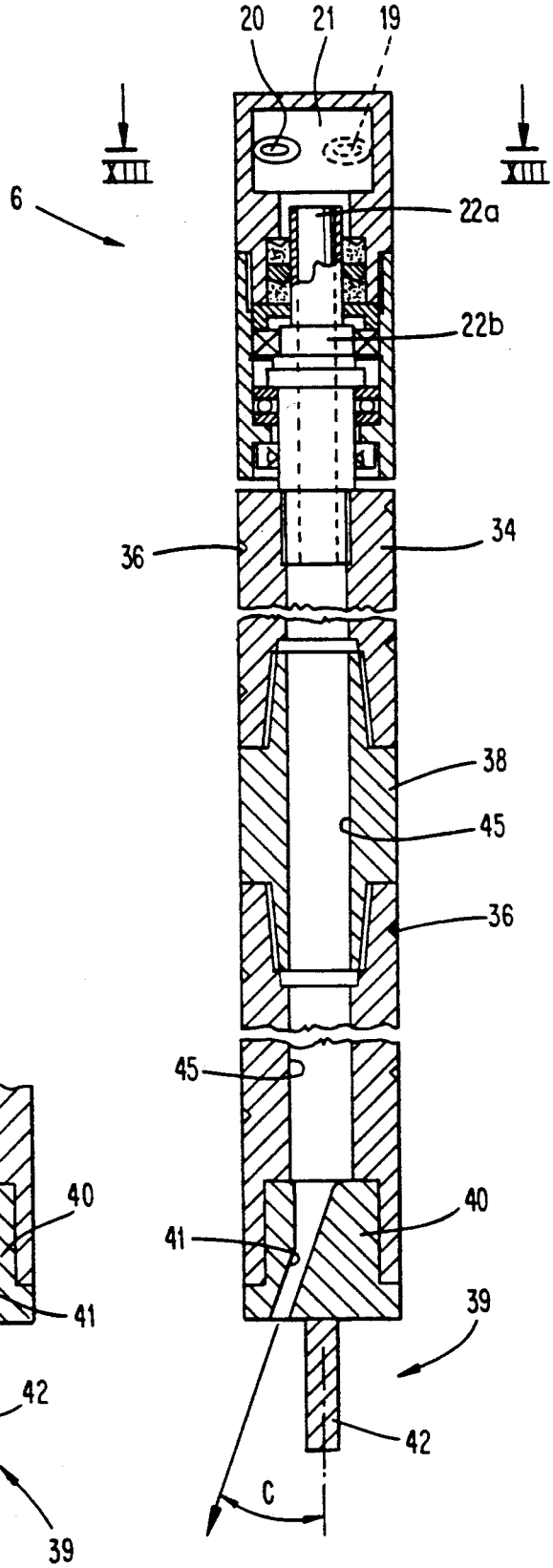
Fig. 10
Fig. 11
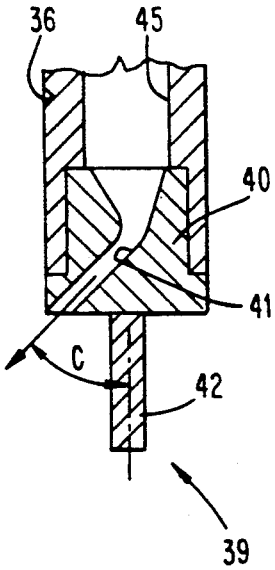
Fig. 12
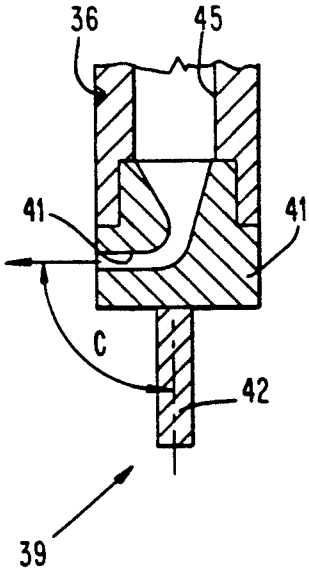

METHOD OF FORMING CONSOLIDATED EARTH COLUMNS BY INJECTION AND THE RELEVANT PLANT AND COLUMN

The invention regards a method by which consolidated earth columns are formed by injection, together with the relevant plant and column; in other words a new procedure for obtaining reinforcing columns in the earth, with reinforcement bars if required, by injecting quantities of cement grout; this application for patent tights also includes the plant to be used with this method and the resulting column.

The technique used consists of an earth consolidation method by which cement grout is injected to obtain reinforcement columns; the method devised by the invention provides for an initial drilling stage to produce a hole of a diameter of about 60 to 90 mm and a depth equal to that of the column to be constructed, on average between approximately 10 m and 30 m: during drilling a cleaning jet of water is injected into the hole at low pressure, in the order of about some tenths of bars and a rate of flow between 80 and 100 l/min; the water supply is then shut off towards the bottom of the hole and the injection of grout is then initiated; the grout is distributed by means of a pair of opposing jets, positioned radially around the excavating head, with a flow diameter of between 1 and 3 mm: this head is gradually extracted from the earth at a constant speed and left to rotate in order to form the column, generally between 60 and 120 cm in diameter, below the jet ejection level; the transverse section of the column, substantially circular in the case of even ground, may be uneven, or in any case irregular, if on the other hand, the earth is made up of a number of different compositions; once the column has been formed, the reinforcement can be lowered into the fresh grout, or if this is not possible, because the column of fresh grout is blocked by landslide fragments, for example, the reinforcement is driven into a central hole in the hardened column with a percussion hammer and cement grout is then poured into the hole.

The plant used during this method utilizes hollow, rotating drills, with excavation heads fitted to the bottom, provided with either three-cone or three-blade boring points, fed by a water pump unit during the drilling stage and then a grout pump unit during injection, at pressures of about 500 bar and rates of flow of 150 l/min.; the water supply is shut off by means of a blocking device, for example a metal ball, inserted at the top of the drill, that drops by force of gravity through the body of the drill, shutting off the flow of water; the radial, opposing jets of grout are emitted through ejector nozzles with a flow diameter of approximately 1 to 3 mm, positioned around the perimeter of the distributor fitted at the base of the drill; the grout is fed from the top of the drill, by means of a rotating joint-type manifold with radial inlet, positioned at right angles to the drill.

Another method whereby micro-piles, of simple design and referred to as "valve-controlled" are formed, consists of the drilling of a hole of a diameter of between 100 and 300 mm, down to the required depth, at the same time attaching a protective jacket to the walls of the hole; a disposable mortar distribution pipe, with lateral inlets at fixed intervals along its surface and protected by coupling valves, is inserted into the hole; mortar is then poured into the circular gap between the pipe and the protective jacket; once the jacket has been removed a blocking device fitted with two plates is inserted inside the distribution pipe, with the plates placed over the inlets in the lower part of the pipe, in order to isolate the section of the pipe where the bottom coupling valve is situated; the injection tube is then fed from the upper plate with cement grout at a pressure of about 10–30 Bar and is continued until the earth is saturated, the coupling valve forces the grout through to the surrounding earth, to form a ring-shaped peripheral layer, separating it from the cylindrical body of the column already cast and situated at the level of the lower coupling valve; once the grout has been completely fed, the blocking device is raised so that it can then isolate a section of the distributor pipe where the coupling valve directly above is situated, thereby allowing another dividing layer to be formed, and so on.

The laying of tie-beams, designed to create for example, elements capable of resisting slippage of overlying earth, or lateral elements to support concrete walls, in the case of filling-in operations, is carried out using the following method: a hole is made in the earth with a boring drill of a diameter of about ten centimeters; as the excavating head is lowered, a metal jacket is inserted to support the walls of the hole; once the required depth has been reached, the boring drill is extracted and a metal element resistant to tensile stress and acting as reinforcement of the tie-beam, for example string steel strands or highly resistant metal bars, is inserted in the hole; cement grout or mortar is then poured into the hole, at low pressure, whilst the metal jacket is gradually removed, until the hole has been filled completely; once the grout/mortar has set, the strands or bars can be stressed to give the earth an artificial state of compression stress, to resist landslides or slippages.

The method involving the formation of consolidated earth columns with the insertion of a reinforced body, is considerably time-consuming and particularly complex to perform, considering firstly, the need to disassemble the end of the drill once drilling has been completed, in order to extract the blocking device and thereby restore the water supply required to proceed with further drilling, and secondly, the frequency with which the nozzles become blocked, thereby requiring regular cleaning and, often, costly replacement; furthermore, slight deviations in the drilling axis often occur due to the lack of uniformity of the earth composition, thereby leading to consolidation with irregular columns and lower resistance, entirely unsuitable if the columns are to form part of a formation of penetrated or closely-packed elements making up, for example, water-proof barriers or surroundings for wells or plinth bases; also the construction of the column below the nozzle injection level disturbs the underlying ground considerably and may cause blocking wedges, especially when materials with a high friction angle are being consolidated, such as gravel which is highly unstable and subject to vertical slipping, possibly blocking the boring drill and thereby causing expensive damage and considerable time loss; furthermore, the flow of the earth removed during drilling is difficult to control and may accumulate in large amounts at the edge of the hole; finally, if the cement injecting stage is interrupted for prolonged periods, even if the grout continues to be mixed, its grip may be adversely affected.

As regards the plant, the rotating joint manifold, situated at the top of the boring drill and fed by a pump unit, whose inlet receiving either water or grout is positioned at right angles to the drill, is subject to transverse stress with respect to the axis of the drill: this stress causes uneven wear on the manifold seals, thereby causing grout to leak into the internal chamber of the manifold and causing the internal rotary section joined to the top of the drill and the external sliding section joined to the pump unit delivery conduits, to jam.

As far as the consolidating columns are concerned, the substantially circular shape limits its capacity, particularly in "soft" types of earth. It is true that the uneven shape obtained with earth that is not uniform, increases the vertical sliding friction of the column due to the irregular shapes protruding from the body of the cylinder; nevertheless, firstly this type of protruding formation cannot be controlled and secondly, they are barely capable of resisting cutting pressures exerted on them, consisting solely of water and cement.

Furthermore, the insertion of the reinforcement body into the fresh grout is extremely difficult due to the unpredictable nature of the earth when the reinforcement is being laid.

As regards the methods involving the formation of micro piles, each drilling appears to be both extremely time-consuming and costly.

In addition, as far as the laying of tie-beams is concerned, the metal strand is inserted manually thereby wasting a considerable amount of time and the diameters of the columns are also limited by the corresponding diameters of the preliminary borings.

The techniques previously described are open to considerable improvement in order to avoid the problems referred to. It appears that there is a need for the technical problems to be resolved by finding a method of forming injected, earth-consolidating columns which increases efficiency yet at the same time reduces time consumption and thereby increases productivity; such a method should also allow earth-consolidating columns to be constructed without the need for excavation, providing each consolidated column with a metal reinforced core, thereby improving the efficiency of the consolidation and at the same time reducing costs; as far as the plant is concerned, this should be reliable and not require long and costly maintenance and fitting procedures after each drilling; the feeding manifold head should not jam against the boring drill; the column should be highly resistant to sinking, especially when "soft" types of earth are being consolidated.

The invention resolves the technical problems described above, using a method whereby injected consolidating earth columns are formed in the manner described below.

A) Preparation of consolidating grout, composed either of cement grout or mortar, incorporating aggregates with a granule size within the sand range, or grout or mortar mixed with polymeric, epoxidic or fibrous substances designed to obtain increasing resistance, such as the substances already mentioned, in order to give the grout the following particular characteristics: elasticity, water-tightness, resistance, friction-proof quality, resistance to washing away, more lengthy or delayed grip; the diameter of the particles of these substances should not exceed one third of that of the jet described in stage C to follow;

B) Drilling to a penetration depth that avoids excessive piling of the surface layer of earth (outcrop) during the next stage when the grout is injected at high pressure, to an average depth of about a meter, using either a dry-boring method or by injecting the consolidating grout at low pressure and low rate of flow; in the latter case, the grout also acts as a lubricant for the drilling equipment;

C) Continual injection of consolidating grout with either a single jet of a wide diameter, up to as much as a few centimeters in the minimum flow section, or a number of jets with a smaller diameter, depending on the granule size of the grout and the effect desired with respect firstly to the clearing of the earth and secondly to cutting; these jets can also be made to incline downward from the axis of the boring drill in order to widen the columns or form truncated cone-shaped projections converging upwards; injecting must be performed with the grout under high pressure, in the order of 500 bar and over, and with rate of flow up to 1000 l/min and over, measured upstream from the boring drill; the consolidating grout is fed more easily to the drill by allowing a downward vortical movement of the mixture at the mouth of the drill;

D) Formation of the column by penetration in descent, regulating the translation speed as well as the rotation speed of the boring drill and the rate of flow and pressure of the grout, depending on the composition of the earth and the form required for the column or the tie-beam: for the cylindrical sections, these parameters should be constant, whereas for the truncated cone-shaped sections, the penetration speed should be reduced and/or the pressure or capacity of the grout should be increased;

E) Once the penetration depth has been reached and the boring drill has been extracted, either the supply of grout in the case of consolidated earth columns in cement grout, is shut off, or the drill from the control device is disconnected, in the case of columns constructed with reinforcement bars and the drill is left inside the column of fresh consolidating grout as a reinforcement.

In the course of this operation, the plant uses the following devices:

a rotating joint manifold, situated at the top of the boring drill, consisting of a tubular section which is attached to the drill along a common axis, allowing the consolidating grout to pass from the feed chamber above, which is housed inside the manifold head and supported as it rotates by the tubular section; this head, of hollow construction, is provided with two inlets tangentially arranged with respect to the feed chamber, each at an angle of between approximately 5° and 50° from the plane at right angles to the axis of the drill, in this way allowing the material to descend; the inlets are positioned in such a way as to create a pulsating torque, rotating with the same frequency as that of the pump group and in the opposite direction to that of the rotation of the drill, thereby preventing the head from dragging as a result of the friction created by the boring drill;

to form consolidated earth columns with cement grout: a consolidated grout distributor is attached to the base of the boring drill, lined up with it and equipped with a boring tool at its end; the distributor, when used with consolidating grout containing cement grout and in cases where an earth-cutting action is required, it is fitted with five holes to house the ejector nozzles: the lower ejector nozzle fitted in a position parallel with the drill produces the base jet which displaces the earth before it is removed by the boring tool; the transverse ejector nozzles which have a combined action, of forming the column and acting as feed auxiliaries are situated on the lateral surface of the distributor, in the section above the cutting ring, in pairs diametrically opposite each other, with at least one pair of nozzles the axes of which, even though not incident to the axis of the drill, are inclined at an angle of between approximately 15° and 75° from said axis (larger angles produce columns with greater diameters) and at least one pair of ejector nozzles positioned at right angles to the drill so that the grout is projected the maximum distance from the drill; the distributor may also be equipped, in place of the nozzles, with at least one lateral ejection hole with a diameter of between a few millimeters and one centimeter or over, inclined at an angle of between approximately 15° and 90° from the axis of the drill; smaller angles are recommended for earth which is difficult to drill; this hole can also be used in the body of the cutting ring, to provide more effective drilling;

to form consolidated earth columns with metal reinforcement: a series of disposable shafts is used, making up the body of the boring drill, connected to each other by short tubes and threaded externally at both ends; the upper shaft is fitted to the bottom of the tube on the rotating joint manifold above, and the lower shaft of the drill is coupled to a base piece, cylindrical in shape and axially disposed at the end of body of the drill, the upper part having a smaller diameter for insertion inside the axial cavity of the drill, thereby restricting the section through which the grout passes; this base piece is fitted, in the straight section next to the grout delivery section, with a converging tube, inclined at about 15° to 90° from the axis of the boring drill, with a diameter ranging between at least a few millimeters and a few centimeters depending on the size of the aggregates being injected, and used to inject the consolidating grout into the earth; a blade or group of blades are attached to the bottom of the base piece, each with a triangular shaped longitudinal section and placed diametrically along the axis of the drill, fitted with oblique cutters converging in the direction of penetration; the outer cylindrical surface of the drill has helical grooves to help the grout grip the drill.

The consolidated earth column, obtained by this method, in the versions with or without metal reinforcement, should, to produce maximum resistance and stability, be composed of a central body, substantially cylindrical, with truncated cone-shaped projections converging upwards, protruding along its length at fixed intervals; these projections are obtained by the action of the jets, diverging in the direction of the boring.

The advantages of this invention are: drastic reduction in time taken to from consolidation columns and consequently a considerable reduction in costs; the drilling cycle is simplified considerably; greater reliability, also resulting from a reduction in necessary maintenance; greater control of discarded earth that cannot be removed due to the action of the inclined jets; elimination of damaging blows resulting from the formation of the column above the volume of earth operated on by the jets; decrease in errors of verticality as a result firstly of the removal of earth by the inclined or coaxial jets, prior to the subsequent removal by the boring tool, and secondly of the movement of the boring drill itself in liquid/plastic surroundings; reduced likelihood of rotating joint manifold head jamming against drill; possibility of consolidating sunken earth, with or without the need for bearing structures; greater precision when centering reinforcement in column of consolidating grout; more effective clearance of earth resulting in better compaction; drilling cycle greatly simplified; non-cylindrical columns produced with greater resistance.

The first version of the distributor referred to, used to form consolidated earth columns, is supplied with the following nozzles:

a nozzle axially disposed at the end of the distributor;

pair of nozzles inclined at 45° from the body of the drill positioned on the lateral surface of the distributor next to the boring tool, for example 50 cm above it;

pair of nozzles, situated on the lateral surface of the distributor, at right angles with the body of the boring drill, arranged at differing heights above the preceding pair of nozzles;

flow diameter of each nozzle between 3 and 5 mm.

A second version of the distributor provides a single flow inlet, a few centimeters above the cutter on the boring tool, inclined downward at 45° from the body of the drill with a flow diameter of between 6 and 12 mm.

In the examples, the minimum average diameter sizes of the column are calculated by taking the minimum values of the working parameters indicated and the diameters of the nozzles; the same applies for the maximum diameters; sizes below, between or above the column diameters can be obtained by varying the working parameter values proportionately and the flow diameters of the nozzles, to give each jet of consolidating grout the energy necessary for the predetermined dimensions of the column to be obtained.

EXAMPLE 1

Consolidation in cohesive earth (with lime-clay matrix) having the following characteristics:

| | |
|---|---|
| Cu (undrained cohesion) below 6 Kg/cm$^2$; Spt (standard penetration test) between 2 and 50; | |
| Composition of consolidating grout: | |
| Water | 550 Kg/m$^3$ |
| Cement | 550 Kg/m$^3$ |
| Sand | 500 Kg/m$^3$ |
| Consolidating grout distributor, first version. | |
| Working parameters: | |
| Penetration speed | from 0.003 to 0.02 m/s |
| Equivalent to insistence time, defined as reciprocal to penetration speedfrom | 1 to 5 min/m |
| Drill rotation speed | from 10 to 20 RPM |
| Grout flow rate | from 300 to 1000 ltrs/m |
| Grout pressure | from 400 to 800 bar |
| Average diameter of consolidated column | from 60 to 120 cm. |

EXAMPLE 2

Consolidation in cohesive earth (with lime-clay matrix) having the following characteristics:

| |
|---|
| Cu (undrained cohesion) below 6 Kg/cm$^2$; |

-continued

| Spt (standard penetration test) between 2 and 50 | |
|---|---|
| Composition of consolidating grout: | |
| Water | 550 Kg/m$^3$ |
| Cement | 550 Kg/m$^3$ |
| Sand | 600 Kg/m$^3$ |
| Consolidating grout distributor, second version. | |
| Working parameters: | |
| Penetration speed | from 0.003 to 0.02 m/s |
| Equivalent to insistence time, defined as reciprocal to penetration speed | from 1 to 5 min/m |
| Drill rotation speed | from 10 to 50 RPM |
| Grout flow rate | from 300 to 1000 ltrs/m |
| Grout pressure | from 400 to 800 bar |
| Average diameter of consolidated column | from 60 to 120 cm. |

EXAMPLE 3

Consolidation in granular earth (sandy) having the following characteristics:

| C (cohesion coefficient) = 0<br>ALFA (friction angle) = 35° | |
|---|---|
| Composition of consolidating grout: | |
| Water | 730 Kg/m$^3$ |
| Cement | 800 Kg/m$^3$ |
| Consolidating grout distributor, first version. | |
| Working parameters: | |
| Penetration speed | from 0.003 to 0.02 m/s |
| Equivalent to insistence time, defined as reciprocal to penetration speed | from 1 to 5 min/m |
| Drill rotation speed | from 10 to 20 RPM |
| Grout flow rate | from 300 to 1000 ltrs/m |
| Grout pressure | from 400 to 800 bar |
| Average diameter of consolidated column | from 100 to 140 cm. |

EXAMPLE 4

Consolidation in granular earth (sandy) having the following characteristics:

| C (cohesion coefficient) = 0<br>ALFA (friction angle) = 35° | |
|---|---|
| Composition of consolidating grout: | |
| Water | 730 Kg/m$^3$ |
| Cement | 800 Kg/m$^3$ |
| Consolidating grout distributor, second version. | |
| Working parameters: | |
| Penetration speed | from 0.003 to 0.02 m/s |
| Equivalent to insistence time, defined as reciprocal to penetration speed | from 1 to 5 min/m |
| Drill rotation speed | from 10 to 50 RPM |
| Grout flow rate | from 300 to 1000 ltrs/m |
| Grout pressure | from 400 to 800 bar |
| Average diameter of consolidated column | from 100 to 140 cm. |

A third version of the device referred to, used to obtain reinforced consolidated earth columns, is fitted with a boring and injecting drill with an outer diameter of 90 mm and 10 mm thick, equipped at its end with a base piece with fitted converging tube, inclined downward at 45° from the body of the drill and a minimum flow diameter of between 6 and 12 mm; a triangular boring point is fixed to the base piece, 100 mm in length, 50 mm in height and a few centimeters thick.

In the examples, the minimum average diameter sizes of the column are calculated by taking the minimum values of the working parameters indicated and the minimum flow diameter; the same applies for the maximum diameters; sizes below, between or above the column diameters can be obtained by varying the working parameter values proportionately and the flow diameters of the nozzles, to give each jet of consolidating grout the energy necessary for the predetermined dimensions of the column to be obtained.

EXAMPLE 5

Consolidation in cohesive earth (with lime-clay matrix) having the following characteristics:

| Cu (undrained cohesion) below 6 Kg/cm$^2$;<br>Spt (standard penetration test) between 2 and 50 | |
|---|---|
| Composition of consolidating grout: | |
| Water | 500 Kg/m$^3$ |
| Cement | 500 Kg/m$^3$ |
| Sand | 600 Kg/m$^3$ |
| Drill boring and injecting consolidating grout contemporaneously as defined above. | |
| Working parameters: | |
| Penetration speed | from 0.003 to 0.02 m/s |
| Equivalent to insistence time, defined as reciprocal to penetration speed | from 1 to 5 min/m |
| Drill rotation speed | from 10 to 50 RPM |
| Grout flow rate | from 300 to 1000 ltrs/m |
| Grout pressure | from 400 to 800 bar |
| Average diameter of consolidated column | from 60 to 120 cm. |

EXAMPLE 6

Consolidation in granular earth (sandy) having the following characteristics:

| C (cohesion coefficient) = 0<br>ALFA (friction angle) = 35° | |
|---|---|
| Composition of consolidating grout: | |
| Water | 730 Kg/m$^3$ |
| Cement | 800 Kg/m$^3$ |
| Drill boring and injecting consolidating grout contemporaneously as defined above. | |
| Working parameters: | |
| Penetration speed | from 0.003 to 0.02 m/s |
| Equivalent to insistence time, defined as reciprocal to penetration speed | from 1 to 5 min/m |
| Drill rotation speed | from 10 to 50 RPM |
| Grout flow rate | from 300 to 1000 ltrs/m |
| Grout pressure | from 400 to 800 bar |
| Average diameter of consolidated column | from 100 to 140 cm. |

To obtain columns or column sections with truncated coneshaped projections, maintaining the same working parameters referred to above, the drill penetration speed is reduced in order to increase the quantity of grout injected into the earth per linear meter of penetration; this then increases the diameter of the column, according to the ratio:

$$D = 2K\sqrt{\frac{Q}{\pi}}$$

where:

D=diameter of the column at the points where section is larger by virtue of the projections;

Q=quantity of consolidating grout per meter of column, necessary for the projections to be produced;

K=numeric coefficient according to:

a) quantity of water in excess of that required for hydration of cement;

b) discarded earth at mouth of boring;

c) state of earth fracturation;

the coefficient varies between 0.4, in the case where at least one of the above-mentioned factors a), b), c) has the maximum value, and 0.9 in the case where all the above-mentioned factors a), b), c) have the minimum values contemporaneously.

Some of the ways in which the invention can be used are illustrated, purely by way of examples, in the ten sketches attached, where:

FIG. 3 shows the enlarged cross section III—III, of the rotating joint manifold shown in FIG. 2;

FIG. 4 is an interrupted, transparent, longitudinal view of the consolidating grout distributor;

FIG. 5 is the transverse section V—V of FIG. 4;

FIG. 10 shows the longitudinal section of the boring drill, complete with disposable reinforcement bar;

FIG. 11 shows a cross section detail of the end of the boring drill with grout flow conduit inclined at 45° from the body of the drill;

FIG. 12 shows a cross section detail of the end of the drill but with the ejection conduit in a right-angled position;

Figure 1:
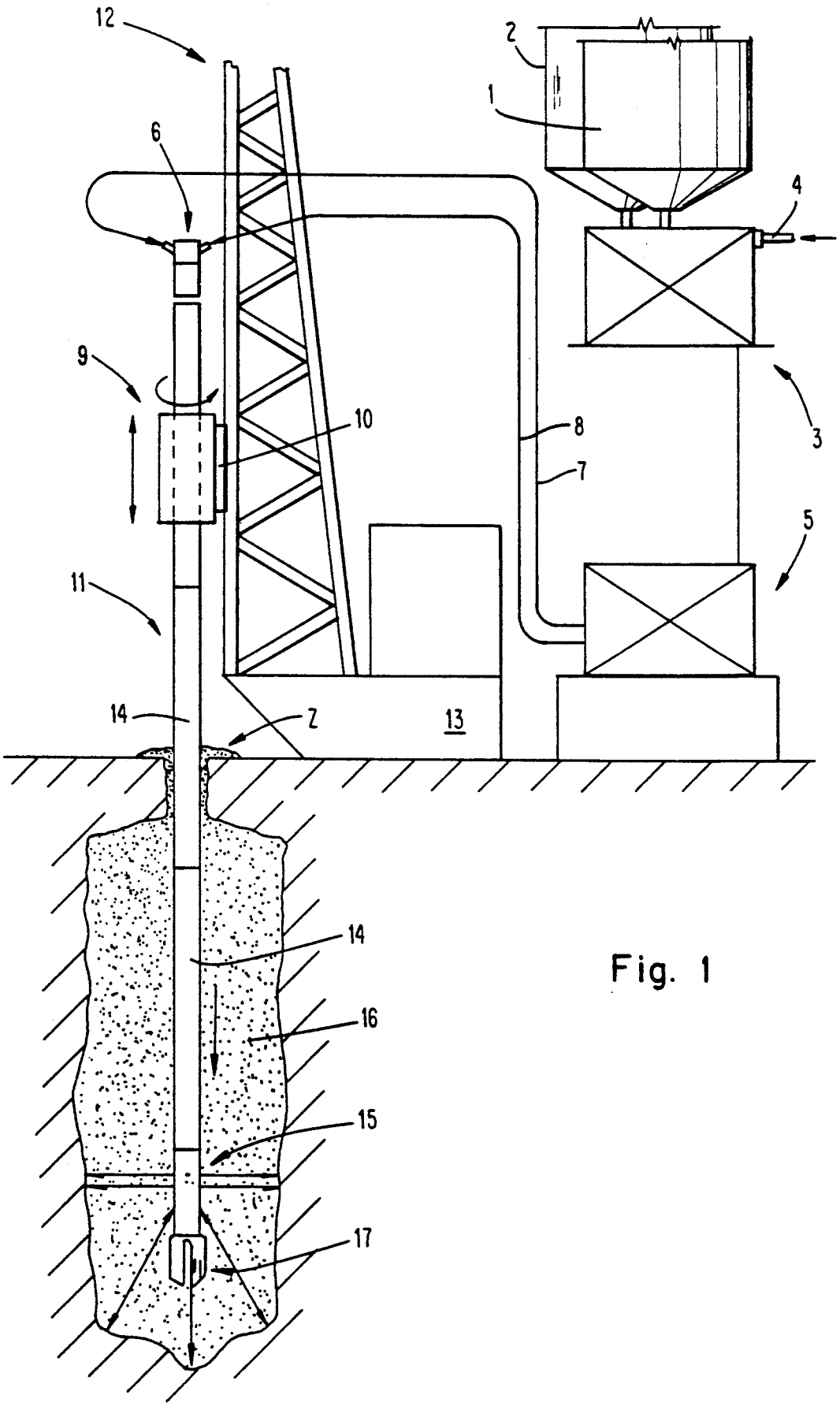
FIG. 1 is a schematic view of a boring plant forming columns injected at high pressure according to the method devised by the invention, with a cross section of the underlying earth illustrating the area in which the column is formed.
Figure 2:
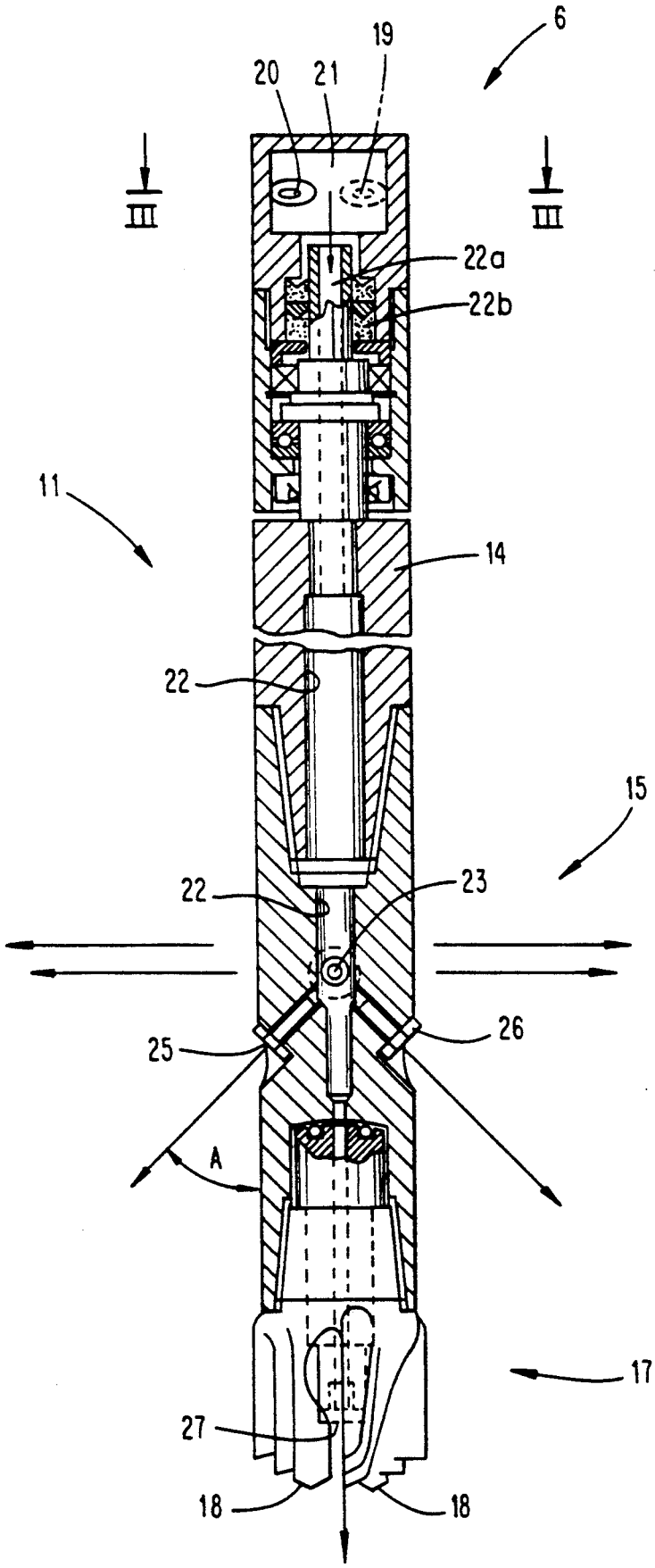
FIG. 2 shows a partial, interrupted longitudinal section of the boring drill, complete with rotating feed manifold, intermediate shaft and grout distributor onto which the five ejector nozzles are fitted.
Figure 8:
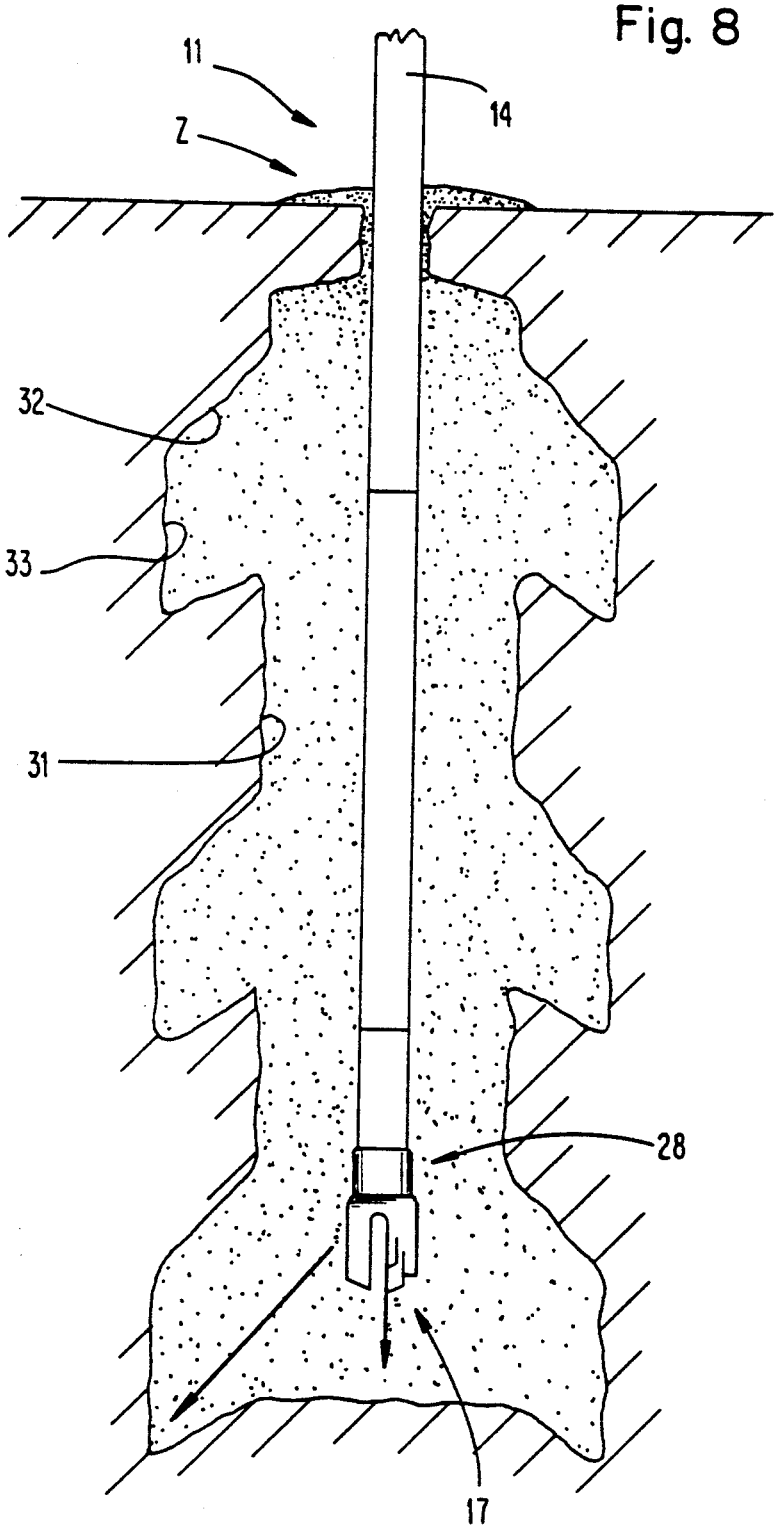
FIG. 8 shows the longitudinal section, in schematic form, of a column with truncated cone-shaped projections converging downward, obtained by the method devised by the invention.
Figure 9:
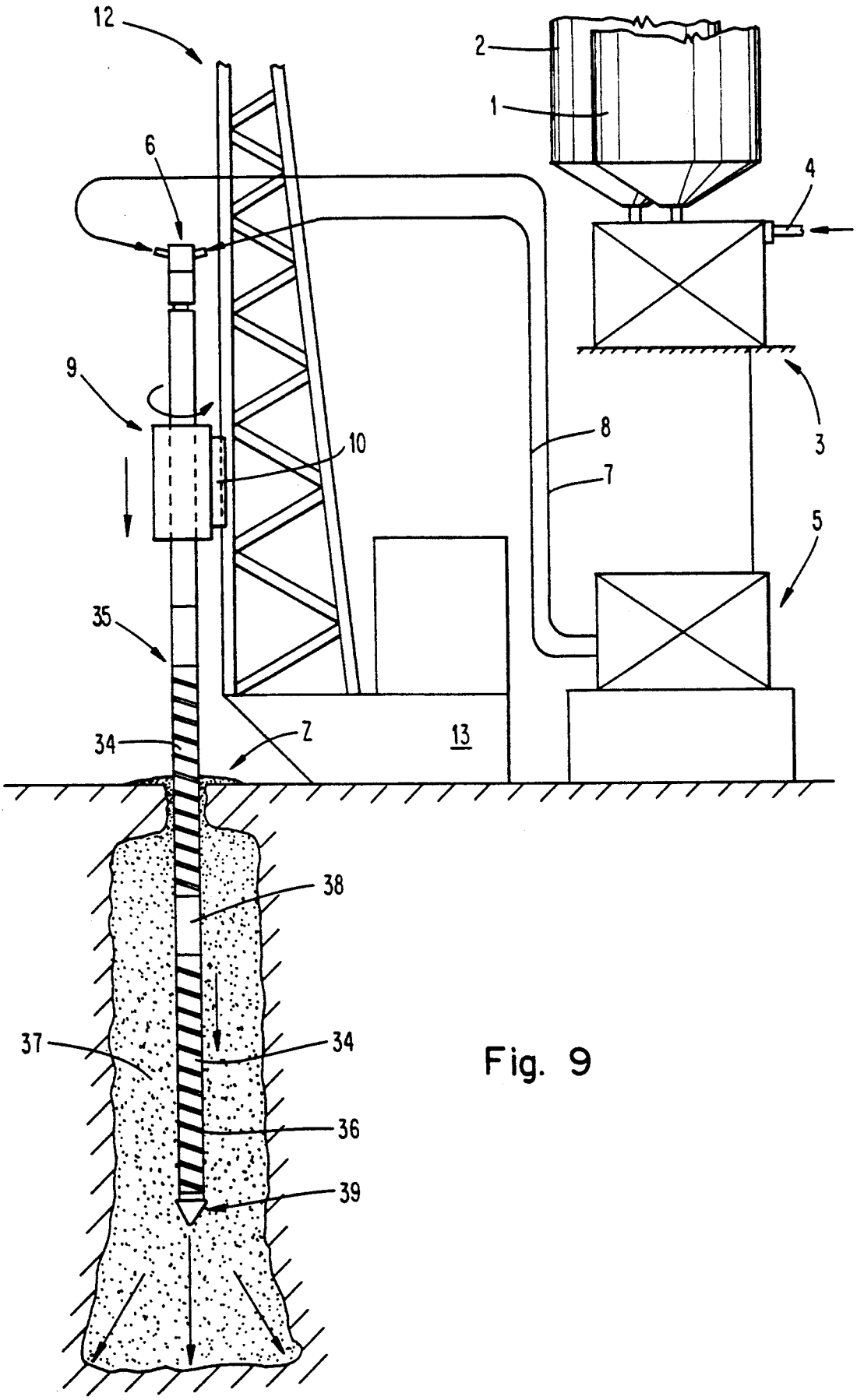
FIG. 9 shows a view of the boring plant fitted with disposable shafts as devised by the invention, showing also a cross section of the underlying earth in the area where the reinforced consolidated column is formed by means of the disposable boring shaft.
Figure 14:
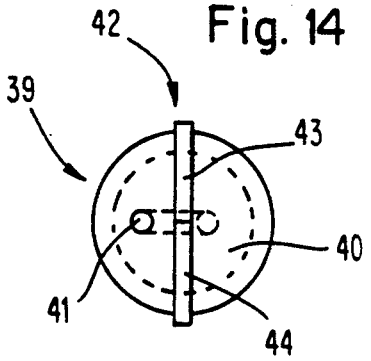
FIG. 14 is a view from below of the boring point with two cutters.
Figure 15:
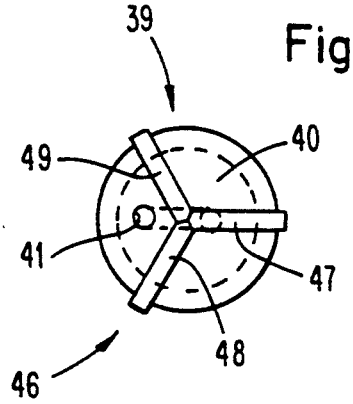
FIG. 15 shows a view from below, as in FIG. 14, but in this case, the boring point is fitted with three cutters.
Figure 16:
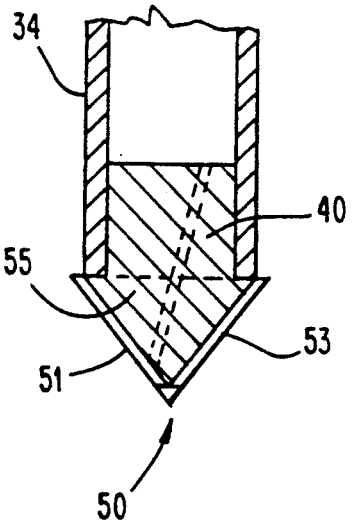
FIG. 16 shows a longitudinal section of the boring point with the cutters pushed back.
Figure 17:
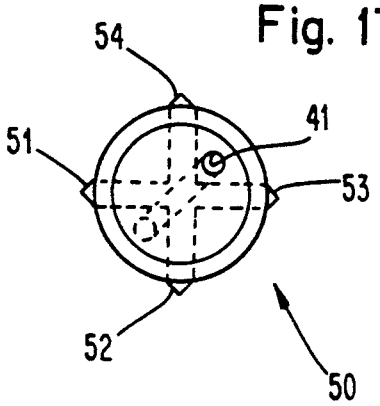
FIG. 17 is a view of FIG. 16 from above.
Figure 18:
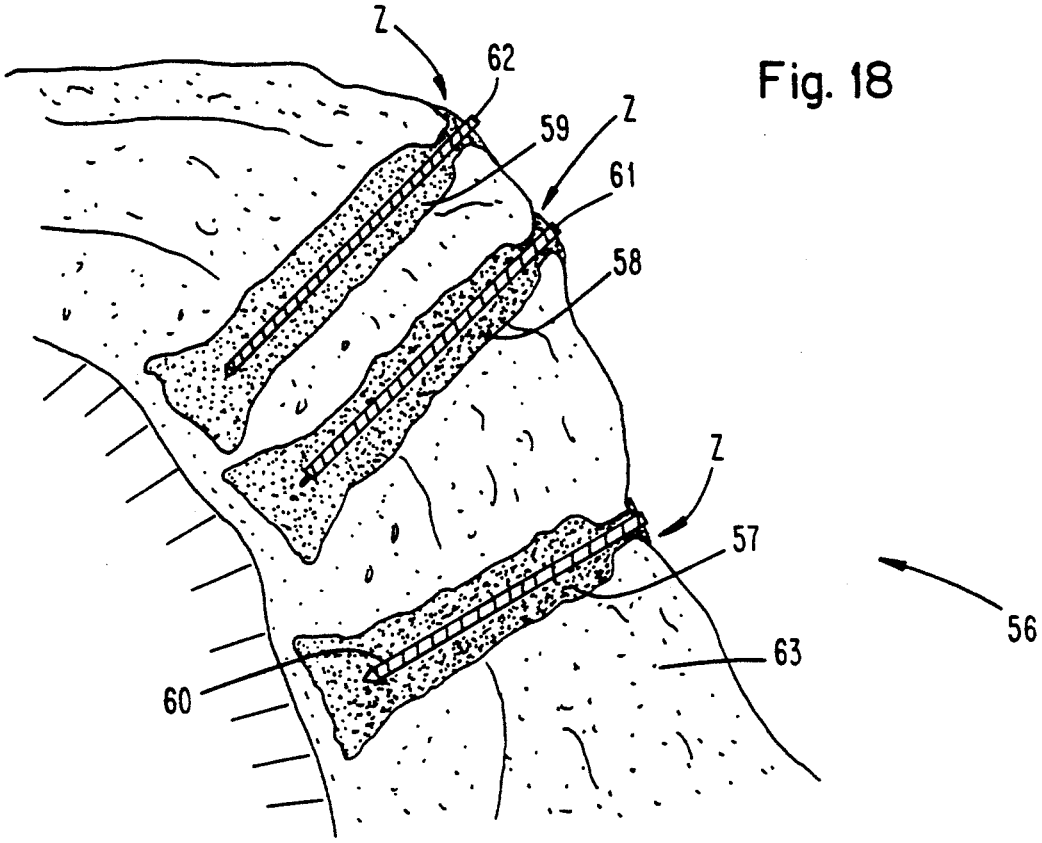
FIG. 18 is a longitudinal section of the reinforced injected columns as devised by the invention, acting as tie-beams.
Figure 19:
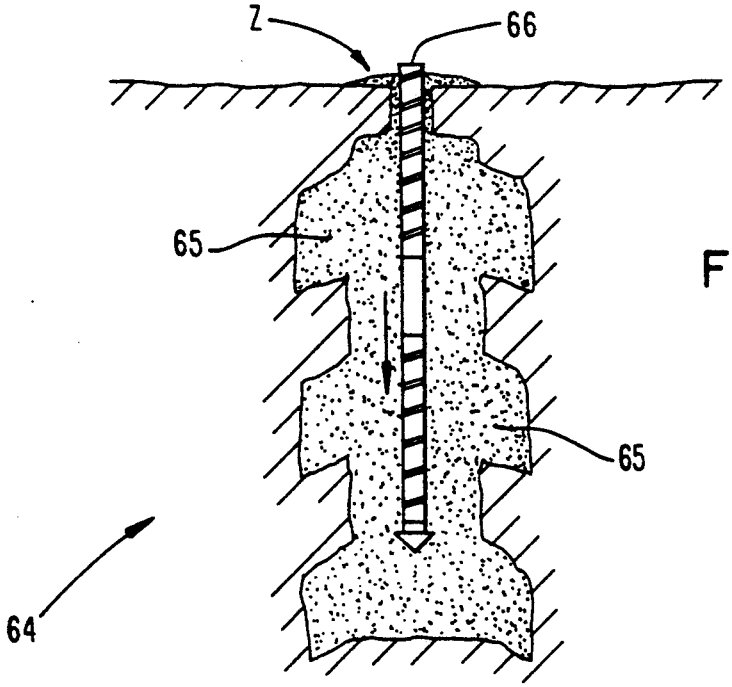
FIG. 19 is a longitudinal section of the reinforced column as devised by the invention, in the truncated cone-shaped projection version.

The indications are as follows:

1 is the cement storage container; 2 is an additional silos for lithoid substances, with granule size falling within the sand range; 3 is a water mixer, fed via the pipe 4 with the cement stored in container 1 and any aggregates contained in silos 2: chemical reagents such as clays, ground fibres or others may be added to the sand and cement; 5 is the pumping station, taking consolidating grout from the mixer 3 and then sending it, at high pressure and flow rate, to the rotating joint manifold 6, via a pair of hoses, 7 and 8; 9 is a chuck which slides vertically along the slideway 10, driving the rotary boring drill 11 into the earth: this slideway is fitted at the side to a boring pylon whose height is proportionate to the boring depth required; 13 is the support, usually mobile, for the boring pylon; 14 are the tubular shafts making up the body of the boring drill 11; a distributor, 15 is fitted to the bottom of the drill, providing an outward flow of consolidating grout used to construct the column 16; 17 is the boring tool, fitted below the distributor, and equipped with cutters 18; 19 and 20 (FIG. 2) represent the pair of inlets situated along the perimeter of the rotating head 6, through which the injecting grout enters, the feed chamber 21: these inlets are inclined, converging downward at an angle from the plane at right angles to the axis of the drill of between approximately 5° and 50° and tangentially arranged with respect to the cylindrical internal surface of the feed chamber 21; 22 is a vertical, cylindrical conduit forming part of the boring drill, connected to the feed chamber 21 via an axially disposed tubular section 22*a*, which is screwed to the top of the drill, with externally varying diameters along its length, forming the rotary element of the manifold 6 and supporting the manifold head as it rotates; 22*b* is a seal between the head and the tubular section, preventing the consolidating grout from leaking out of the feed chamber 21; 23 and 24 (FIG. 4) are a pair of upper radial ejector nozzles, positioned at right angles to the drill 11, at different heights along its axis; 25 and 26 represent a pair of nozzles, incident to the body of the drill 11, inclined from the vertical plane at an angle A, between approximately 15° and 75°: larger angles produce columns with wider diameters, thereby decreasing the drilling effect; 27 is a vertically-ended nozzle used to remove the virgin earth broken up by the mechanical action of the cutters 18: each nozzle has a threaded tang which is screwed into a nut on the body of the distributor 15; 28 (FIG. 6) is the distributor with a single flow inlet, situated close to the cutters 18 on the boring tool 17; the body of the tool houses a lower chamber 29 in the axially disposed extension of the cylindrical conduit: this chamber extends downward to form an inlet 30 for the grout, inclined from the drill axis at an angle B, appropriately between approximately 15° and 90°, where smaller angles are particularly suited to earth that is hard to drill; 28a (FIG. 7) represents the distributor with single flow inlet, situated behind the cutter 18 on the boring tool 17; this distributor has a flow inlet 30a, on the lateral cylindrical surface of the distributor; 31 (FIG. 8) is a column formed with truncated cone-shaped projections converging downward, separated along their axis by cylindrical sections 33, obtained in accordance with the method devised by the invention, with the use of nozzle supporting devices of either the single inclined nozzle type or the five-nozzle type, blocking the irregularly positioned nozzles on the horizontal axis; Z represents the outcrop; 34 (FIG. 9) are the disposable shafts making up the body of the boring drill 35, whose outer surface has helical grooves to help the grout forming the reinforced column 37, attach itself to the drill; 38 is a joint with threaded ends, screwed onto the shafts 34 and preventing the grout from leaking while under pressure; 39 is the boring tool, fixed to the bottom of the lower shaft, consisting of a base piece 40 (FIG. 10) housing a tube 41, converging to form the ejector nozzle and whose internal surface is hardened to resist wear: this tube is inclined from the axis of the boring drill 35, at an angle C, between approximately 15° and 90°; smaller angles are appropriate for earth that is difficult to drill; a point 42 made up of two triangular cutters is fixed underneath this base piece, with the base of the cutters on the base piece and the sides 43 and 44 (FIG. 14) converging downward; 45 is the vertical cylindrical conduit connected to the chamber 21 in the rotating joint manifold by a through hole 22a, in the body 22b, forming a rotary coupling for the manifold 6 and supporting it as it rotates; 46 (FIG. 15) illustrates a star-shaped point equipped with three cutters 47, 48 and 49, positioned radially 120° from each other; 50 illustrates a conical-shaped point formed by four cutter blades, 51, 52, 53 and 54, generating from opposite sides of the cone at the bottom of the base piece; 56 (FIG. 18) illustrates a formation of three reinforced columns 57, 58 and 59, into which are inserted the reinforcement bars 60, 61 and 62, forming tie-beams or anchorings for the surrounding earth 63 being consolidated; 64 (FIG. 19) illustrates a column formed with truncated cone-shaped projections 65, converging downward, together with reinforcement 66; 67 (FIG. 20) is a partition, normally constructed in reinforced concrete, enclosing the excavation, from which tie-beams 68 protrude towards the virgin earth, made up of columns 69 injected with reinforcement bars 70, as devised by the invention; the partitions 67 can also be made up of high-pressure injected column panels, with embedded reinforcement; 71 is a lateral load partition plate.

Taking FIG. 1 to 5, operations are carried out as follows: the grout is prepared inside the mixer 3, this is then sucked into the pump unit 5 and sent, at high pressure and flow rate, to the rotating joint manifold body 6; it then passes through the conduit 22 leading to the distributor 15 and is injected into the ground through transverse nozzles 23 and 24, inclined nozzles 25 and 26 and axially disposed end nozzle 27; injection is started after a preliminary dry boring phase, to a depth that does not cause excessive outcrop.

Figure 6:
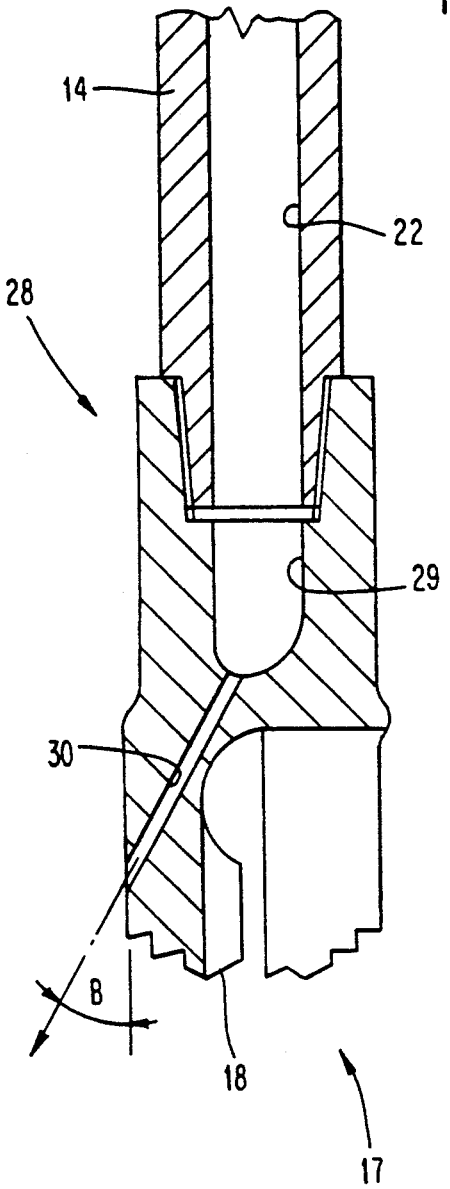
FIG. 6 shows the longitudinal section of the distributor where the flow of grout is provided by a single ejector inlet situated near the cutter on the boring tool.
Figure 7:
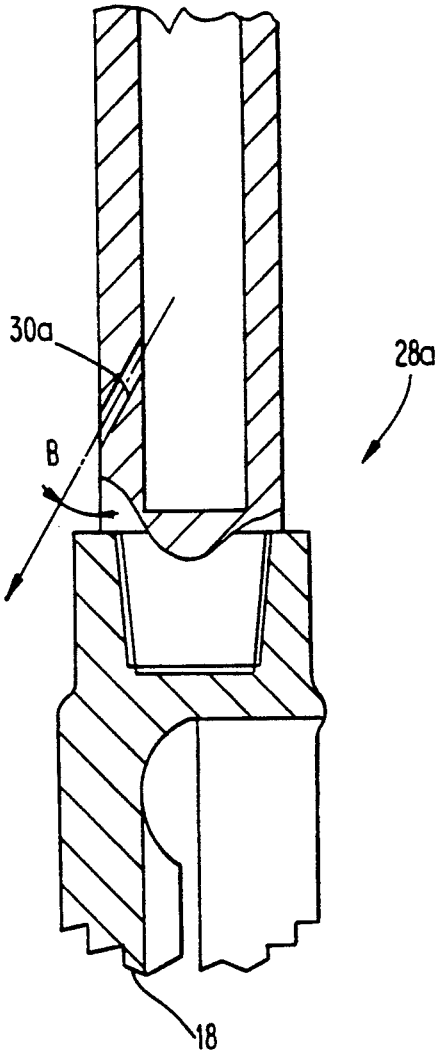
FIG. 7 shows the longitudinal section of the distributor, as illustrated in FIG. 6, but with the flow inlet positioned further away from the cutter.

FIGS. 6 and 7 illustrate the injection of the grout into the earth through a flow pipe positioned either in the body of the boring tool (FIG. 6), or in the wall of the distributor (FIG. 7).

Figure 13:
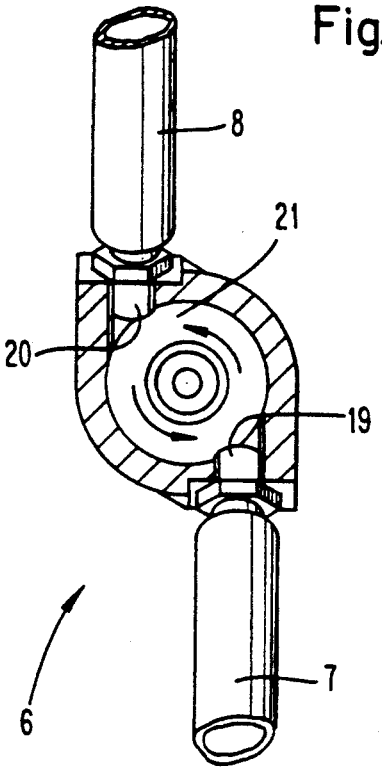
FIG. 13 shows an enlarged transverse section XIII—XIII, of the rotating joint manifold illustrated in FIG. 10, similar to that in FIG. 3.
Figure 20:
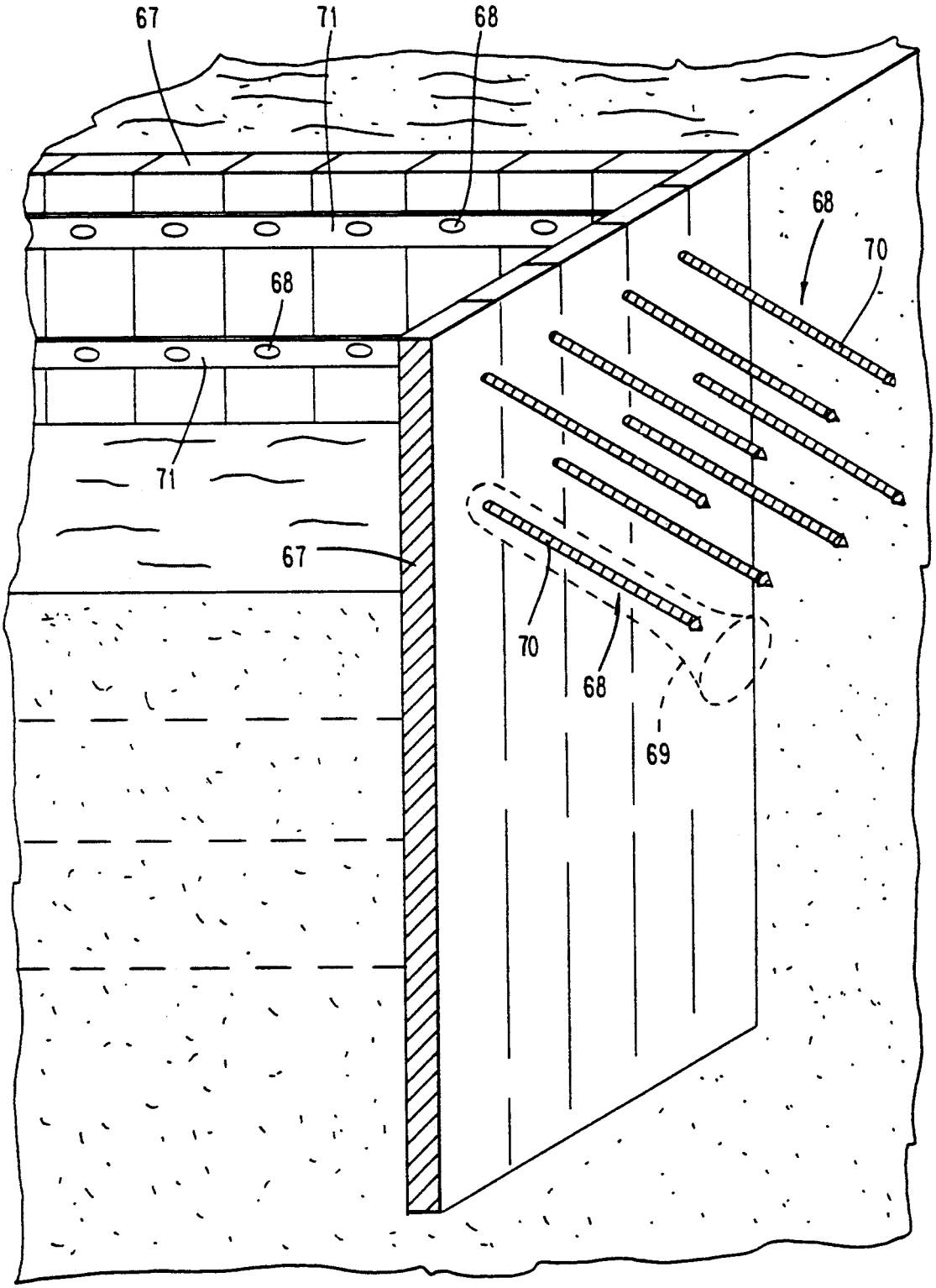
FIG. 20 is a prospective view of a vertical wall enclosing excavations with partitions supported by lateral tie-beams.

FIGS. 11, 12 and 13 illustrate the following operations: first either dry boring is carried out or consolidating grout is injected at low pressure and flow rate, serving solely as a lubricant, the drill 34, being thrust downward by the chuck fitted to the slideway 10; once a suitable depth has been reached, bearing in mind the accumulation of outcrop, pumping of the consolidating grout is started at very high pressure and flow rate, through the feed hoses 7 and 8; the grout is injected through the pipe 41, into the ground, while the drill continues to rotate and penetrate; once the required penetration depth has been reached, the supply is shut off and the drill is left in position. In FIG. 20, the columns 68, acting as tie-beams, are injected along a horizontal drilling axis, through holes in the walls 67 enclosing excavations while in progress.

In practice, the materials, sizes, executive details, composition of consolidating grout, the nature and type of aggregates and additives used, the number of ejector nozzles can differ from those indicated, provided they are technically equivalent, without going beyond the legal scope of this invention.

The outcrop Z or mixed formations at the summit of the columns, including funnelling, can also be removed by the injection of consolidating grout at fairly low pressure towards the extraction travel limit of the drill 14; in any event, outcrop and any infiltrations may be eliminated by removing the earth above the summit of the consolidated columns by bucket.

We claim:

1. Method of forming a consolidated earth column by injection of a grout, comprising the steps of:

A. preparing a consolidating grout which includes aggregates with a granule size within the sand range, each constituent of the grout not exceeding about one third of the diameter of an opening through which a flow of the grout is injected into the earth;

B. drilling a preliminary hole into the earth, with a drill, to a penetration depth of at least one meter;

C. injecting a flow of consolidating grout via at least one jet rotating around an axis of the drill while the drill is moving downward, the grout being fed at a pressure and at a flow rate sufficient to widen at a substantially predetermined radius the preliminary hole drilled by the drill;

D. forming the consolidating earth column to a required penetration depth while the drill is moving downward.

2. Method according to claim 1, wherein:

said at least one jet is a single jet with a diameter of between a few millimeters and a few centimeters, an axis of the single jet being inclined from said drill axis at an angle of between 0° and 90°.

3. Method according to claim 1, wherein:

said at least one jet is a plurality of jets each having a diameter of a few millimeters and respective axes inclined from said drill axis at an angle of between 0° and 90°.

4. Method according to claim 1, wherein:

the consolidating grout is injected at a pressure of about 500 bars and at a flow rate of about 1000 l/min.

5. Method according to claim 1, wherein:

the consolidating grout is fed by a downward swirling movement thereof at a mouth of the drill.

6. Method according to claim 1, wherein:

said drill is moved downward by regulating a vertical translation speed as well as a rotation speed of the drill, the flow rate and pressure of the grout being regulated according to a composition of the earth being worked on and a selected form required for the column such that for cylindrical sections such parameters are substantially constant, and for truncated-cone shaped projections the translation speed is reduced and at least one of the pressure or flow rate of the grout is increased.

7. Method according to claim 1, wherein:

the flow of consolidating grout is stopped and the drill is withdrawn from the formed column when the required penetration depth is reached.

8. Method according to claim 1, wherein:

the flow of consolidating grout is stopped and the drill is disconnected from a supporting device and left in the formed column as a reinforcing means when the required penetration depth is reached.

9. Method according to claim 1, wherein:

the consolidating grout is composed as follows cement in a range from 200 to 600 Kg/m$^3$, water in a range from 100 to 600 Kg/m$^3$, aggregates in a range from 300 to 1000 Kg/m$^3$, with the density of the consolidating grout being below 2200 Kg/m$^3$.

10. Method according to claim 9, wherein:

the consolidating grout contains the following additives, in the weight percentages indicated below bentonite in a range from 1 to 5 plastifying or densifying agent in a range from 0.1 to 5%, epoxy resins in a range from 0.1 to 5%, and reswelling polymers in a range from 0.1 to 5%.

11. Method according to claim 1, wherein:

a flow of the consolidating grout at low pressure and low flow rate is injected into the earth while the drilling of the preliminary hole is in progress.

12. Method according to claim 3, wherein:

the consolidating grout is composed as follows water in a range 550 Kg/m$^3$, cement in a range 550 Kg/m$^3$, sand in a range 500 Kg/m$^3$, and the working parameters have values of vertical translation speed of the drill when the drill is moving downward in a range from 0.003 to 0.02 m/s, drill rotation speed in a range from 10 to 20 rpm, consolidating grout flow rate in a range from 300 to 1000 1/min, and consolidating grout pressure in a range from 400 to 800 bars, the consolidating column formed having a cylindrical section with a diameter of between about 60 cm and 120 cm, the consolidating grout being injected via five jets each having a flow diameter of between 3 mm and 5 mm, the jets being positioned with an axially disposed jet at the bottom end of drill, a first pair of jets inclined downward from a drilling axis at an angle of 45°, the jets being positioned diametrically opposed each other, and a second pair of jets inclined from a drilling axis at an angle of 90°, the jets being positioned diametrically opposed each other above the first pair of jets at different vertical distances therefrom.

13. Method according to claim 2, wherein:

the consolidating grout is composed as follows:

| | |
|---|---|
| water | 500 Kg/m$^3$, |
| cement | 500 Kg/m$^3$, and |
| sand | 600 Kg/m$^3$ |

and the working parameters have the following values vertical translation speed of the drill when the drill is moving downward in a range from 0.003 to 0.02 m/s, drill rotation speed in a range from 10 to 50 rpm, consolidating grout flow rate in a range from 300 to 1000 1/min, and consolidating grout pressure in a range from 400 to 800 bar, the consolidating column formed having a cylindrical section with a diameter of between about 60 cm and 120 cm, the consolidating grout being injected via a single jet having a flow diameter of between about 6 mm and 12 mm, the single jet being inclined from a drilling axis at an angle of 45°.

14. Method according to claim 3, wherein:

the consolidating grout is composed as follows

| | |
|---|---|
| water | 730 Kg/m$^3$, |
| cement | 800 Kg/m$^3$, |

and the working parameters have the following values vertical translation speed of the drill when the drill is moving downward in a range from 0.003 to 0.02 m/s, drill rotation speed in a range from 10 to 20 rpm, consolidating grout flow rate in a range from 300 to 1000 1/min, and consolidating grout pressure in a range from 400 to 800 bar, the consolidating column formed having a cylindrical section with a diameter of between about 100 cm and 140 cm, the consolidating grout being injected via 5 jets each having a flow diameter of between 3 mm and 5 mm, the jets being positioned with an axially disposed jet at the bottom end of drill, a first pair of jets inclined downward from said drill axis at an angle of 45°, the jets being positioned diametrically opposed each other, and a second pair of jets inclined from a drilling axis at an angle of 90°, the jets being positioned diametrically opposed each other above the first pair of jets at different vertical distances therefrom.

15. Method according to claim 2, wherein:

the consolidating grout is composed as follows

| | |
|---|---|
| water | 730 Kg/m$^3$, |
| cement | 800 Kg/m$^3$ |

and the working parameters have the following values vertical translation speed of the drill when the drill is moving downward in a range from 0.003 to 0.02 m/s, drill rotation speed in a range from 10 to 50 rpm, consolidating grout flow rate in a range from 300 to 1000 1/min, and consolidating grout pressure in a range from 400 to 800 bar, the consolidating column formed having a cylindrical section with a diameter of between about 100 cm and 140 cm, the consolidating grout being injected via a single jet having a flow diameter of between about 6 mm and 12 mm, the single jet being inclined from said drill axis at an angle of 45°.

16. Method according to claim 8, wherein:

the consolidating grout is composed as follows

| | |
|---|---|
| water | 500 Kg/m$^3$, |
| cement | 500 Kg/m$^3$, and |
| sand | 600 Kg/m$^3$, |

and the working parameters have the following values vertical translation speed of the drill when the drill is moving downward in a range from 0.003 to 0.02 m/s, drill rotation speed in a range from 10 to 50 rpm, consolidating grout flow rate in a range from 300 to 1000 1/min, and consolidating grout pressure in a range from 400 to 800 bar the consolidating column formed having a cylindrical section with a diameter of between about 60 cm and 120 cm, the consolidating grout being injected via a single jet having a flow diameter of between about 6 mm and 12 mm, the single jet being inclined from a drilling axis at an angle of 45°.

17. Method according to claim 8, wherein:

the consolidating grout is composed as follows

| | |
|---|---|
| water | 730 Kg/m$^3$, |
| cement | 800 Kg/m$^3$, |

and the working parameters have the following values;

vertical translation speed of the drill when the drill is moving downward in a range from 0.003 to 0.02 m/s, drill rotation speed in a range from 10 to 50 rpm, consolidating grout flow rate in a range from 300 to 1000 1/min, and consolidating grout pressure in a range from 400 to 800 bar, the consolidating column formed having a cylindrical section with a diameter of between about 100 cm and 140 cm, the consolidating grout being injected via a single jet having a flow diameter of between about 6 mm and 12 mm, the single jet being inclined from said drill axis at an angle of 45°.

18. Apparatus for forming consolidated earth columns by injection of a group comprising:

a water mixer for consolidating group;

a pump unit; and a rotary drill provided with an axial passage, said rotary drill being equipped at its top with a rotary joint manifold supplying a flow of consolidating grout and at its bottom with a grout distributor and an excavating tool, wherein said rotary joint manifold includes at least a pair of inlet passages tangentially arranged in a grout feed chamber and inclined downward, said inlet passages being arranged such that a flow of grout supplied to said feed chamber via the inlet passages generates a torque in a direction opposite to a direction of rotation of the rotary drill, the grout distributor being equipped with at least one ejecting nozzle.

19. Apparatus according to claim 18, further comprising:

a tubular body having different outer diameters along its length, placed between the rotary joint manifold and the top end of the rotary drill, said rotary joint manifold being rotationally supported by said tubular body.

20. Apparatus according to claim 18, wherein:

said grout distributor is connected to said bottom end of the rotary drill and to a top end of an excavating tool, the grout distributor being equipped with an axial chamber connected to the axial passage of the rotary drill and with five ejecting nozzles, each of said nozzles being connected to the axial chamber, the five ejecting nozzles comprising a first pair of nozzles each having an axis inclined at an angle of between approximately 15° and 75° from the axis of the drill, a second pair of nozzles each having an axis positioned at right angle from the axis of the drill, and a bottom nozzle having an axis parallel to the axis of the rotary drill.

21. Apparatus according to claim 20, wherein:

at least one of the ejecting nozzles has an axis intersecting the axis of the rotary drill.

22. Apparatus according to claim 20, wherein:

the nozzles of the second pair of nozzles are positioned at different heights and at a greater vertical distance from the bottom end of the drill than the first pair of nozzles.

23. Apparatus according to claim 20, wherein:

the nozzles of the second pair of nozzles are coaxial and have an axis intersecting the axis of the drill.

24. Apparatus according to claim 18, wherein:

said grout distributor is connected to a bottom end of the rotary drill and to a top end of an excavating tool, the grout distributor being equipped with a central chamber connected to the axial passage of the rotary drill and with a single ejecting nozzle connected to said central chamber, said single ejecting nozzle being inclined from the axis of the drill at an angle of between 15° and 90°.

25. Apparatus according to claim 24, wherein:

said single ejecting nozzle passes through the body of the excavating tool.

26. Apparatus according to claim 24, wherein:

the grout distributor is constituted by the bottom tubular section of the rotary drill, the single ejecting nozzle being positioned at a vertical distance from the excavating tool

27. Apparatus according to claim 18, wherein:

the rotary drill comprises a plurality of disposable hollow shaft sections connected to each other by coaxial hollow joints externally threaded at both ends, the bottom hollow shaft section being connected to an excavating tool comprising a base piece constituting the grout distributor and at least one blade connected at the bottom end of the base piece, the base piece housing a passage converging downward to form an ejecting nozzle, the axis of the ejecting nozzle being inclined from the axis of the drill at an angle of between approximately 15° and 90°.

28. Apparatus according to claim 27, wherein:

said excavating tool is equipped with a triangular blade with cutters converging downward.

29. Apparatus according to claim 27, wherein:

the excavating tool is equipped with a group of three blades, an angle between two adjacent blades of the group being substantially equal to 120°.

30. Apparatus according to claim 27, wherein:

the base piece of said excavating tool is provided with a bottom end constituted by a conical body equipped with built-up cutters on its outer surface, an angle between two adjacent cutters being substantially equal to 90°.

31. Apparatus according to claim 27, wherein:

the disposable hollow shaft sections of the drill are provided with helical grooves on their outer surface.

32. A consolidated column, obtained according to the method of claim 6, formed with consolidating grout and having a substantially cylindrical shape with peripheral projections.

33. A consolidated column, obtained according to the method of claim 6, consisting of a cylindrical body along which truncated-cone shaped projections converging downward protrude at fixed intervals.

34. A consolidated column, obtained according to the method of claim 8, formed with consolidating grout and having a substantially cylindrical shape with peripheral projections, said column incorporating reinforcing means constituted by the disposable hollow shaft sections of the rotary drill.

35. A consolidated column, obtained according to the method of claim 8, consisting of a cylindrical body along which truncated-cone shaped projections converging downward protrude at fixed intervals, said column incorporating reinforcing means constituted by the disposable hollow shaft sections of the rotary drill.

* * * * *